US010369601B2

(12) United States Patent
Davis

(10) Patent No.: US 10,369,601 B2
(45) Date of Patent: Aug. 6, 2019

(54) SUCTIONAL CLEANING SYSTEM

(71) Applicant: Steven Davis, Ft. Myers, FL (US)

(72) Inventor: Steven Davis, Ft. Myers, FL (US)

( * ) Notice: Subject to any disclaimer, the term of this patent is extended or adjusted under 35 U.S.C. 154(b) by 181 days.

(21) Appl. No.: 15/445,359

(22) Filed: Feb. 28, 2017

(65) Prior Publication Data

US 2018/0243805 A1 Aug. 30, 2018

(51) Int. Cl.

| | |
|---|---|
| ***B08B 5/04*** | (2006.01) |
| ***B08B 9/035*** | (2006.01) |
| *F24F 13/22* | (2006.01) |

(52) U.S. Cl.

CPC ..... *B08B 9/035* (2013.01); *B08B 5/04* (2013.01); *F24F 13/222* (2013.01)

(58) Field of Classification Search

CPC ..... B08B 9/035; B08B 5/04; B08B 15/002; F24F 13/222; A47L 5/38; D01H 11/005; B23Q 11/0046; B65H 2701/31

See application file for complete search history.

(56) References Cited

U.S. PATENT DOCUMENTS

| | | | | |
|---|---|---|---|---|
| 5,085,244 | A * | 2/1992 | Funk | B08B 9/0321 134/102.1 |
| 5,722,458 | A * | 3/1998 | Potter | F16K 5/0207 137/240 |
| 6,143,996 | A * | 11/2000 | Skanda | A47L 5/38 15/314 |
| 6,427,458 | B1 | 8/2002 | Fowler | |
| D668,410 | S | 10/2012 | Khubani | |
| 8,535,453 | B1 | 9/2013 | Gonzalez | |
| 8,684,022 | B1 | 4/2014 | McFarland | |
| 8,978,690 | B2 | 3/2015 | Hubbard, Sr. et al. | |
| 8,985,635 | B2 | 3/2015 | Hurley | |
| 2002/0170140 | A1* | 11/2002 | Diaz | A47L 9/02 15/415.1 |

FOREIGN PATENT DOCUMENTS

| | | |
|---|---|---|
| WO | WO9216315 | 10/1992 |

* cited by examiner

*Primary Examiner* — Robert J Scruggs

(57) ABSTRACT

A suctional cleaning system includes a drain line that drains a fluid. The drain line is fluidly coupled to a fluid source. A fitting is fluidly coupled to the drain line and the fluid passes through the fitting. A suction unit is selectively fluidly coupled to the fitting such that the suction unit is in fluid communication with the drain line. The suction unit suctionally cleans the drain line. Moreover, the suction unit selectively directs suction between the plurality of ports.

8 Claims, 6 Drawing Sheets

SUCTIONAL CLEANING SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM.

Not Applicable

STATEMENT REGARDING PRIOR DISCLOSURES BY THE INVENTOR OR JOINT INVENTOR

Not Applicable

BACKGROUND OF THE INVENTION (1) Field of the Invention (2) Description of Related Art including information disclosed under 37 CFR 1.97 and 1.98.

The disclosure and prior art relates to cleaning devices and more particularly pertains to a new cleaning device for cleaning a condensation drain line.

BRIEF SUMMARY OF THE INVENTION

An embodiment of the disclosure meets the needs presented above by generally comprising a drain line that drains a fluid. The drain line is fluidly coupled to a fluid source. A fitting is fluidly coupled to the drain line and the fluid passes through the fitting. A suction unit is selectively fluidly coupled to the fitting such that the suction unit is in fluid communication with the drain line. The suction unit suctionally cleans the drain line. Moreover, the suction unit selectively directs suction between the plurality of ports.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
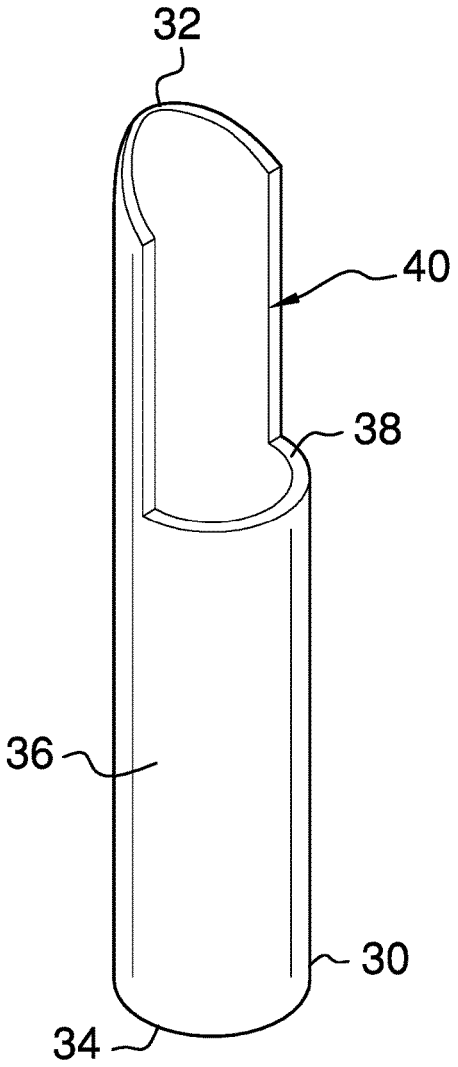
FIG. 1 is a perspective view of a first tube of a suctional cleaning system according to an embodiment of the disclosure.
Figure 2:
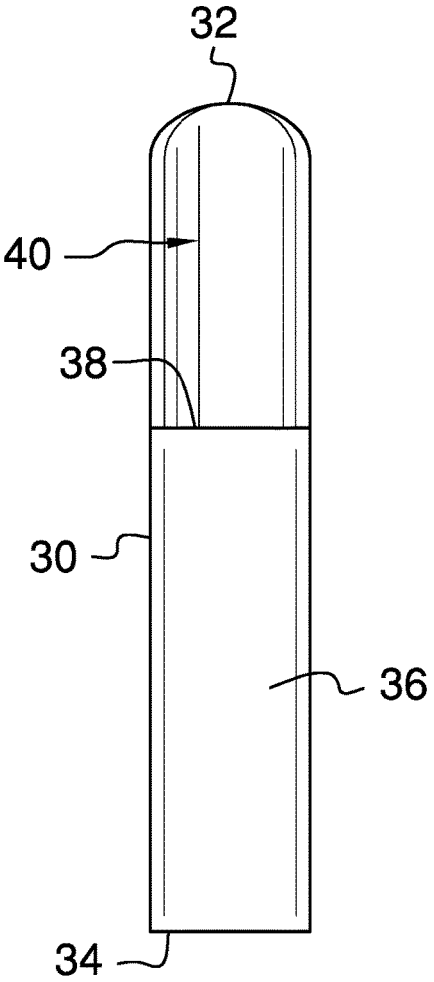
FIG. 2 is a front view of first tube of an embodiment of the disclosure.
Figure 3:
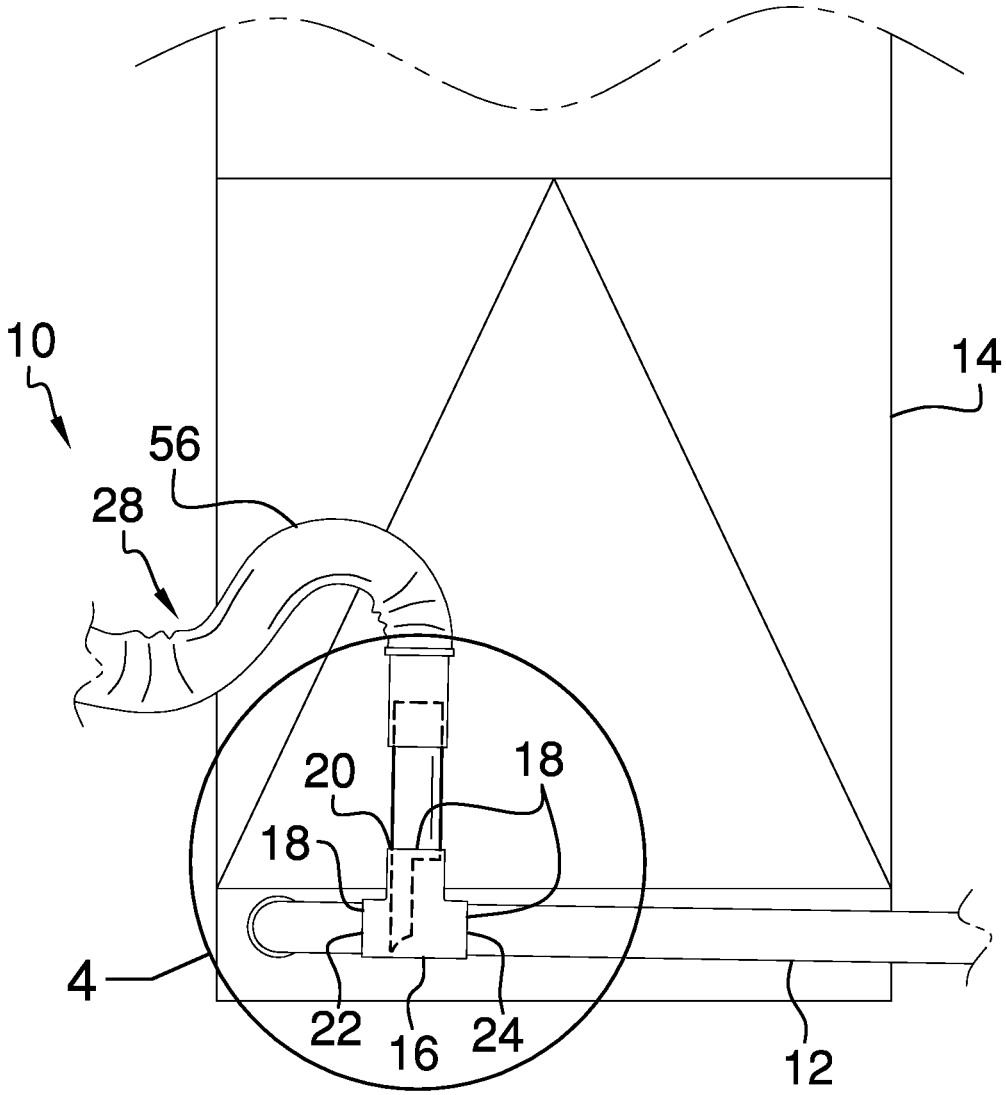
FIG. 3 is a perspective view of said first tube of an embodiment of the disclosure.
Figure 4:
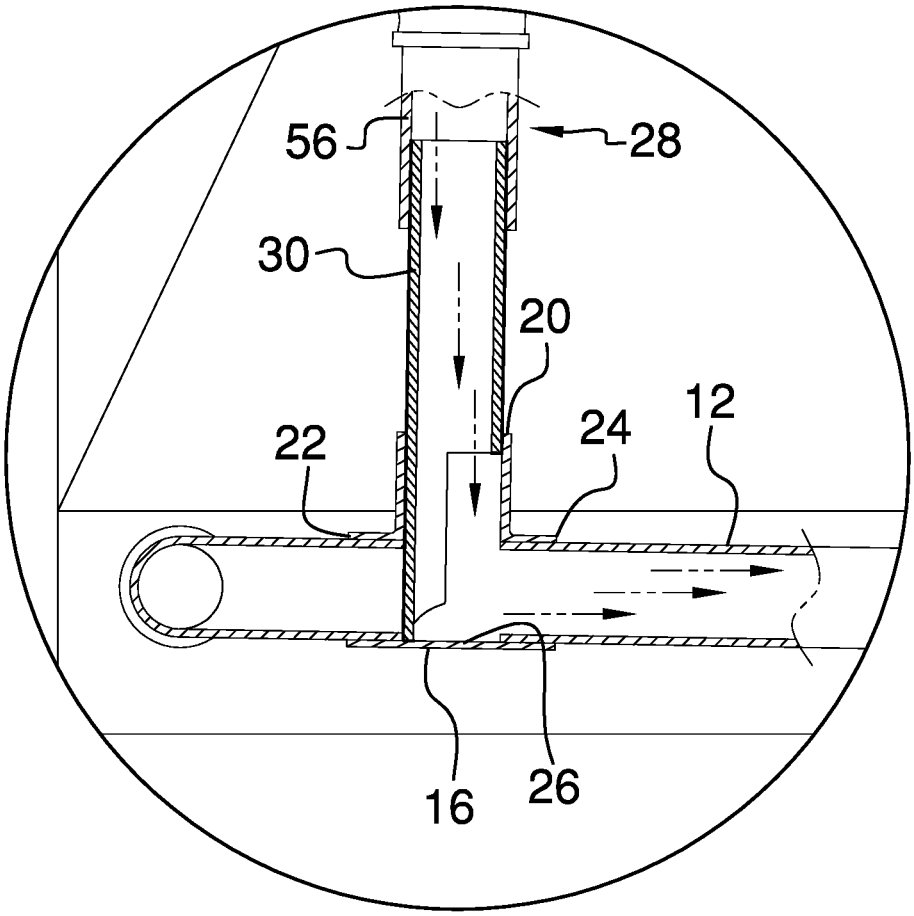
FIG. 4 is a cross sectional view taken along line 4-4 of FIG. 3 of an embodiment of the disclosure.
Figure 5:
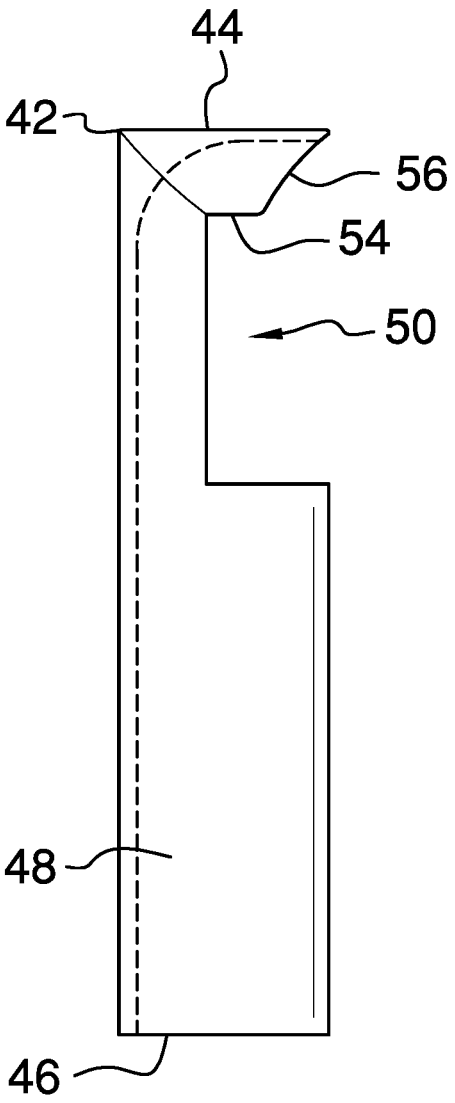
FIG. 5 is a perspective phantom view of second tube of an embodiment of the disclosure.
Figure 6:
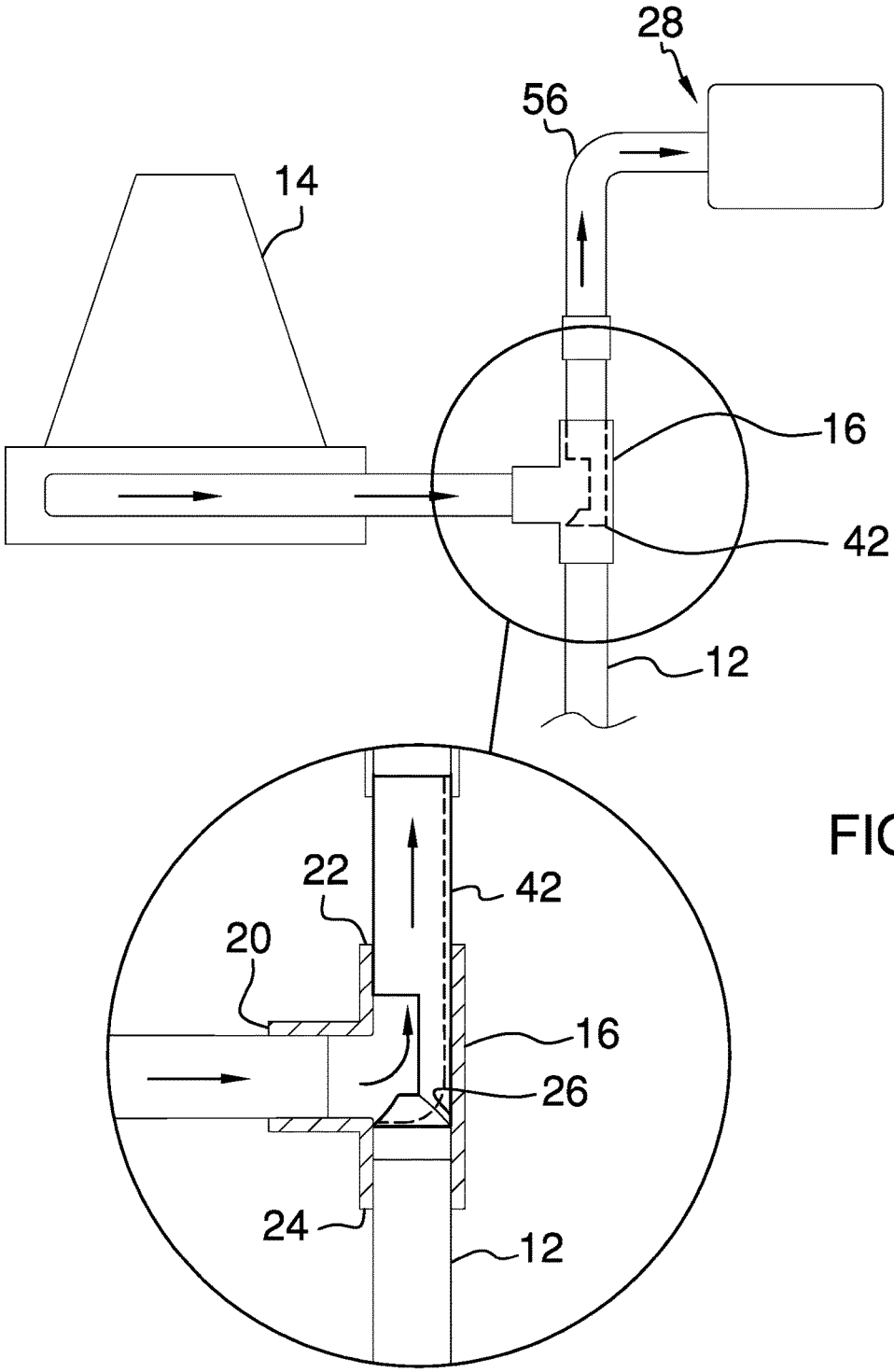
FIG. 6 is a perspective in-use view of a second tube of an embodiment of the disclosure.
Figure 7:
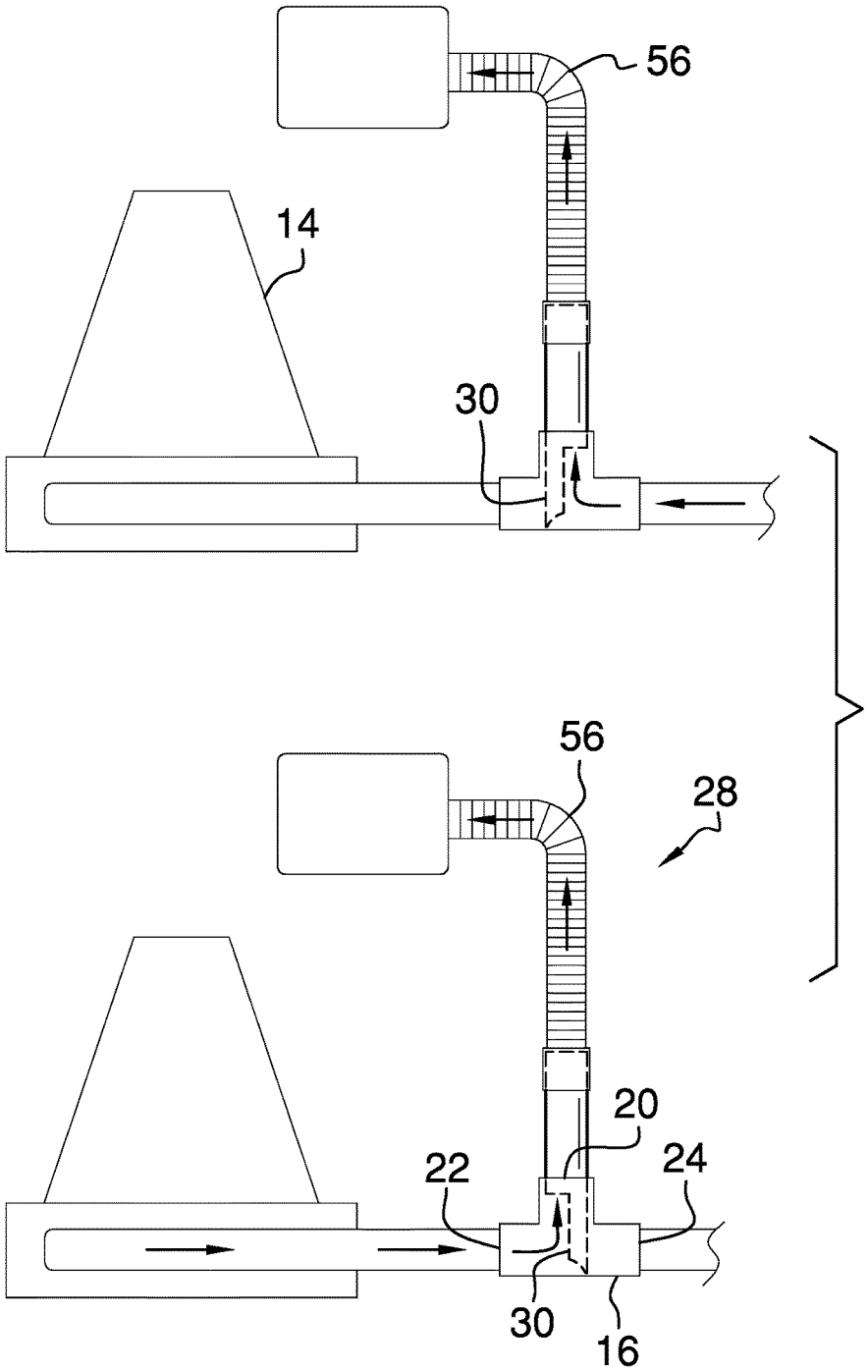
FIG. 7 is a perspective in-use view of a first tube of an embodiment of the disclosure.

With reference now to the drawings, and in particular to FIGS. 1 through 7 thereof, a new cleaning device embodying the principles and concepts of an embodiment of the disclosure and generally designated by the reference numeral 10 will be described.

As best illustrated in FIGS. 1 through 7, the suctional cleaning system 10 generally comprises a drain line 12 that is fluidly coupled to a fluid source 14. In this way the drain line 12 drains a fluid from the fluid source 14. The fluid source 14 may be an air handler in an HVAC system or other forced air system that commonly generates condensation. The drain line 12 may be a condensation drain line on the air handler or the like. Additionally, the fluid may be water condensation from the air handler.

A fitting 16 is provided and the fitting 16 is fluidly coupled to the drain line 12 thereby facilitating the fluid to pass through the fitting 16. The fitting 16 has a plurality of ports 18 and each of the ports 18 is in fluid communication with each other. The plurality of ports 18 includes a first port 20 that is oriented perpendicular to each of an inlet port 22 and an outlet port 24. The inlet port 22 may be fluidly coupled to the fluid source 14. The fitting 16 has an inside surface 26 and the fitting 16 may be a tee-fitting or the like.

A suction unit 28 is provided and the suction unit 28 is selectively fluidly coupled to the fitting 16. In this way the suction unit 28 is in fluid communication with the drain line 12 to suctionally clean the drain line 12. The fitting 16 may be previously installed on the drain line 12 with respect to cleaning the drain line 12. Moreover, the fitting 16 may be installed on the drain line 12 at the time the suction unit 28 is employed to clean the drain line 12.

The suction unit 28 comprises a first tube 30 that has a first end 32, a second end 34 and an outer wall 36 extending therebetween. Each of the first end 32 and the second end 34 is open and the outer wall 36 has a first cut 38 therein. The first cut 38 extends inwardly toward a center of the first tube 30 and longitudinally toward the first end 32. In this way the first cut 38 defines a bisected portion 40 of the first tube 30 that extends from the first end 32 toward the second end 34. The first end 32 is concavely arcuate with respect to the second end 34.

The first tube 30 is selectively inserted into the first port 20 on the fitting 16 having the first end 32 abutting the inside surface 26 of the fitting 16. The first end 32 is coarcuate with the inside surface 26 of the fitting 16. In this way the first end 32 forms a fluid impermeable seal with the inside surface 26 when the first tube 30 in inserted into the first port 20. The first tube 30 is selectively rotated into a first position having the bisected portion 40 being aligned with the outlet port 24. In this way the first tube 30 inhibits air from passing between the inlet port 22 and the first port 20. The first tube 30 is selectively rotated into a second position having the bisected portion 40 being aligned with the inlet port 22. In this way the first tube 30 inhibits air from passing between the outlet port 24 and the first port 20.

A second tube 42 is provided that has a primary end 44, a secondary end 46 and an outside wall 48 extending therebetween. The secondary end 46 is open, the primary end 44 is closed and the second tube 42 is substantially hollow. The outside wall 48 has an opening 50 extending into an interior of the second tube 42. Moreover, the opening 50 extends substantially between the primary end 44 and the secondary end 46.

The opening 50 has a first bounding edge 52 and a second bounding edge 54. The second bounding edge 54 is spaced from the primary end 44. Additionally, the first bounding edge 52 is concavely arcuate between the primary end 44 and the second bounding edge 54. The second tube 42 is selectively inserted the inlet port 22 of the fitting 16 having the primary end 44 blocking an intersection between the outlet port 24 and the first port 20. Moreover, the opening 50 is aligned with the first port 20 to inhibit air from passing between the outlet port 24 and the inlet port 22. The second tube 42 is selectively inserted the outlet port 24 of the fitting 16 having the primary end 44 blocking an intersection between the inlet port 22 and the first port 20. Additionally, the opening 50 is aligned with the first port 20 to inhibit air from passing between the outlet port 24 and the inlet port 22.

A suction source 56 is provided and the suction source 56 is selectively fluidly coupled to the second end 34 of the first tube 30. In this way the suction source 56 is placed in selective fluid communication with the drain line 12. Thus, the suction source 56 is facilitated to suctionally remove fluid and debris from the drain line 12. The suction source 56 is selectively fluidly coupled to the secondary end 46 of the second tube 42. In this way the suction source 56 is placed in selective fluid communication with the drain line 12. The suction source 56 may be a suction hose on a vacuum or the like.

In use, the first end 32 of the first tube 30 is inserted into the first port 20 to clean the drain line 12 when the drain line 12 is fluidly coupled to the outlet port 24 of the fitting 16. The suction unit 28 is suctionally coupled to the second end 34 of the first tube 30. Moreover, the first tube 30 is selectively into the first position to suck the debris and fluid from the drain line 12. In this way the drain line 12 is periodically cleaned for maintenance purposes. The first tube 30 is selectively positioned in the second position to suck the debris and fluid from the fluid source 14. The primary end 44 of the second tube 42 is selectively inserted into the inlet port 22. In this way the suction from the suction unit 28 is directed to flow between the first port 20 and the inlet port 22. The primary end 44 of the second tube 42 is selectively inserted into the outlet port 24. In this way the suction from the suction unit 28 is directed to flow between the first port 20 and the outlet port 24.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A suctional cleaning system comprising:

a drain line being configured to drain a fluid, said drain line being configured to be fluidly coupled to a fluid source;

a fitting being fluidly coupled to said drain line wherein said fitting is configured to pass the fluid therethrough, said fitting having a plurality of ports, said fitting has an inside surface; and a suction unit being selectively fluidly coupled to said fitting such that said suction unit is in fluid communication with said drain line, said suction unit suctionally cleaning said drain line, said suction unit selectively directing suction between said plurality of ports, said suction unit including a first tube having a first end, a second end and an outer wall extending therebetween, each of said first end and said second end being open, said outer wall having a first cut therein, said first cut extending inwardly toward a center of said first tube and longitudinally toward said first end to define a bisected portion of said first tube, said bisected portion extending from said first end toward said second end, said first end is concavely arcuate with respect to said second end, said first tube being selectively inserted into a first port on said fitting having said first end abutting said inside surface of said fitting, said first end being coarcuate with said inside surface of said fitting such that said first end forms a fluid impermeable seal with said inside surface, said first tube being insertable into said fitting such that said tube contacts said inside surface whereby said tube blocks at least one of said ports leaving two ports in fluid communication with each other.

2. The system according to claim 1, wherein:

said fitting has a first port, an inlet port and an outlet port; and said first tube is selectively rotated into a first position wherein said first end is configured to inhibit air from passing between said inlet port and said first port, said first tube being selectively rotated into a second position wherein said first end is configured to inhibit air from passing between said outlet port and said first port.

3. The system according to claim 1, further comprising a second tube, said second tube being interchangeable with said first tube, said second tube having a primary end, a secondary end and an outside wall extending therebetween, said secondary end being open, said primary end being closed, said second tube being substantially hollow, said outside wall having an opening extending into an interior of said second tube, said opening extending substantially between said primary end and said secondary end, said opening having a first bounding edge and a second bounding edge.

4. The system according to claim 3, wherein said second bounding edge is spaced from said primary end, said first bounding edge being concavely arcuate between said primary end and said second bounding edge.

5. The system according to claim 4, wherein:

said fitting has an outlet port, an inlet port and a first port; and said second tube is selectively inserted said inlet port of said fitting having said primary end blocking an intersection between said outlet port and said first port and having said opening being aligned with said first port wherein said second port is configured to inhibit air from passing between said outlet port and said inlet port.

6. The system according to claim 5, wherein said second tube is selectively inserted said outlet port of said fitting having said primary end blocking an intersection between said inlet port and said first port and having said opening being aligned with said first port wherein said second tube is configured to inhibit air from passing between said outlet port and said inlet port.

7. The system according to claim 1, further comprising a suction source being selectively fluidly coupled to said second end of said first tube having said suction source being in fluid communication with said drain line wherein said suction source is configured to suctionally remove fluid and debris from said drain line.

8. A suctional cleaning system comprising:

a drain line being configured to drain a fluid, said drain line being configured to be fluidly coupled to a fluid source;

a fitting being fluidly coupled to said drain line wherein said fitting is configured to pass the fluid therethrough, said fitting having a plurality of ports, each of said ports being in fluid communication with each other, said fitting having an inside surface, said plurality of ports including a first port being oriented perpendicular to each of a inlet port and an outlet port, inlet port being configured to be fluidly coupled to the fluid source; and a suction unit being selectively fluidly coupled to said fitting such that said suction unit is in fluid communication with said drain line, said suction unit suctionally cleaning said drain line, said suction unit comprising:

a first tube having a first end, a second end and an outer wall extending therebetween, each of said first end and said second end being open, said outer wall having a first cut therein, said first cut extending inwardly toward a center of said first tube and longitudinally toward said first end to define a bisected portion of said first tube, said bisected portion extending from said first end toward said second end, said first end being concavely arcuate with respect to said second end, said first tube being insertable into said fitting such that said tube contacts said inside surface whereby said tube blocks at least one of said ports leaving two ports in fluid communication with each other, said first tube being selectively inserted into said first port on said fitting having said first end abutting said inside surface of said fitting, said first end being coarcuate with said inside surface of said fitting such that said first end forms a fluid impermeable seal with said inside surface, said first tube being selectively rotated into a first position wherein said first end is configured to inhibit air from passing between said inlet port and said first port, said first tube being selectively rotated into a second position wherein said first end is configured to inhibit air from passing between said outlet port and said first port;

a second tube, said second tube being interchangeable with said first tube, said second tube having a primary end, a secondary end and an outside wall extending therebetween, said secondary end being open, said primary end being closed, said tube being substantially hollow, said outside wall having an opening extending into an interior of said second tube, said opening extending substantially between said primary end and said secondary end, said opening having a first bounding edge and a second bounding edge, said second bounding edge being spaced from said primary end, said first bounding edge being concavely arcuate between said primary end and said second bounding edge, said second tube being selectively inserted said inlet port of said fitting having said primary end blocking an intersection between said outlet port and said first port and having said opening being aligned with said first port wherein said second port is configured to inhibit air from passing between said outlet port and said inlet port, said second tube being selectively inserted said outlet port of said fitting having said primary end blocking an intersection between said inlet port and said first port and having said opening being aligned with said first port wherein said second tube is configured to inhibit air from passing between said outlet port and said inlet port, and a suction source being selectively fluidly coupled to said second end of said first tube having said suction source being in fluid communication with said drain line wherein said suction source is configured to suctionally remove fluid and debris from said drain line, said suction source being selectively fluidly coupled to said secondary end of said second tube having said suction source being in fluid communication with said drain line.

* * * * *